US010465409B1

(12) United States Patent
Barber

(10) Patent No.: US 10,465,409 B1
(45) Date of Patent: Nov. 5, 2019

(54) FLOOD WATER RETENTION ASSEMBLY

(71) Applicant: Raymond Barber, Houston, TX (US)

(72) Inventor: Raymond Barber, Houston, TX (US)

( * ) Notice: Subject to any disclaimer, the term of this patent is extended or adjusted under 35 U.S.C. 154(b) by 0 days.

(21) Appl. No.: 16/115,172

(22) Filed: Aug. 28, 2018

(51) Int. Cl.

| | |
|---|---|
| ***E02B 3/04*** | (2006.01) |
| ***B65D 88/02*** | (2006.01) |
| ***E03F 1/00*** | (2006.01) |
| ***E04H 9/14*** | (2006.01) |
| ***E02B 3/10*** | (2006.01) |
| *F04D 13/02* | (2006.01) |
| *E03B 11/12* | (2006.01) |
| *E03B 3/40* | (2006.01) |
| *E03B 11/16* | (2006.01) |

(52) U.S. Cl.
CPC ..... *E04H 9/145* (2013.01); *B65D 88/02* (2013.01); *E02B 3/041* (2015.09); *E02B 3/106* (2013.01); *E03F 1/00* (2013.01); *E03F 1/002* (2013.01); *E03B 3/40* (2013.01); *E03B 11/12* (2013.01); *E03B 11/16* (2013.01); *F04D 13/02* (2013.01)

(58) Field of Classification Search
CPC .. E02B 3/04; E02B 3/041; E03F 1/003; E03F 1/005; B65D 88/02; E03B 3/03; E03B 3/32; E03B 3/36
See application file for complete search history.

(56) References Cited

U.S. PATENT DOCUMENTS 4,335,977 A * 6/1982 Ihli ..... E02B 3/04 114/256
4,457,646 A 7/1984 Laesch
4,537,211 A * 8/1985 Almeida ..... B65D 88/08 137/1
4,620,817 A 11/1986 Cushing
D293,360 S 12/1987 Anderson, Sr.
5,342,144 A * 8/1994 McCarthy ..... E03F 1/00 405/36
5,360,290 A * 11/1994 Yamada ..... E02B 9/06 405/52
5,487,621 A * 1/1996 Takada ..... E02B 9/06 405/80
5,909,982 A * 6/1999 Takada ..... E02B 11/00 405/52
5,967,759 A 10/1999 Jurado
(Continued)

FOREIGN PATENT DOCUMENTS

DE 10246580 A1 * 4/2004 ..... E03B 3/04
GB 0418239 * 9/2004 ..... E02B 3/00
WO WO2008021251 2/2008

*Primary Examiner* — Frederick L Lagman

(57) ABSTRACT

A flood water retention assembly for reducing flood damage includes a plurality of repositories that is each positioned proximate a lowland area prone to flooding. A plurality of drain conduits is each fluidly coupled to a respective one of the repositories. Each of the drain conduits is in fluid communication with a drainage area to drain the water into the drainage area. A plurality of inlet conduits is each fluidly coupled to a respective one of the repositories. Each of the inlet conduits is in fluid communication with a body of water to receive water from the body of water. A pump is fluidly coupled to each of the inlet conduits and the pump is positioned adjacent to the body of water. The pump pumps the water into the repositories when the pump is turned on. In this way the repositories contain flood waters thereby reducing flood damage to surrounding areas.

5 Claims, 4 Drawing Sheets

(56) References Cited

U.S. PATENT DOCUMENTS

| | | | | |
|---|---|---|---|---|
| 6,022,172 | A * | 2/2000 | Siyaj | E02B 3/108 405/110 |
| 8,740,500 | B2 | 6/2014 | Conway | |
| 8,814,533 | B2 | 8/2014 | Exner | |
| 2008/0253837 | A1* | 10/2008 | Miller | E02B 9/02 405/80 |
| 2011/0033242 | A1* | 2/2011 | Albrecht | E02B 3/108 405/108 |
| 2011/0182668 | A1* | 7/2011 | Hogan | G06Q 10/06315 405/80 |
| 2013/0319552 | A1* | 12/2013 | Svarczkopf | B65D 13/00 137/565.01 |
| 2014/0056645 | A1* | 2/2014 | Hogan | G01W 1/10 405/80 |
| 2016/0313293 | A1* | 10/2016 | Rauch | G01N 33/1833 |

* cited by examiner

FLOOD WATER RETENTION ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to retention devices and more particularly pertains to a new retention device for reducing flood damage.

BRIEF SUMMARY OF THE INVENTION

An embodiment of the disclosure meets the needs presented above by generally comprising a plurality of repositories that is each positioned proximate a lowland area prone to flooding. A plurality of drain conduits is each fluidly coupled to a respective one of the repositories. Each of the drain conduits is in fluid communication with a drainage area to drain the water into the drainage area. A plurality of inlet conduits is each fluidly coupled to a respective one of the repositories. Each of the inlet conduits is in fluid communication with a body of water to receive water from the body of water. A pump is fluidly coupled to each of the inlet conduits and the pump is positioned adjacent to the body of water. The pump pumps the water into the repositories when the pump is turned on. In this way the repositories contain flood waters thereby reducing flood damage to surrounding areas.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
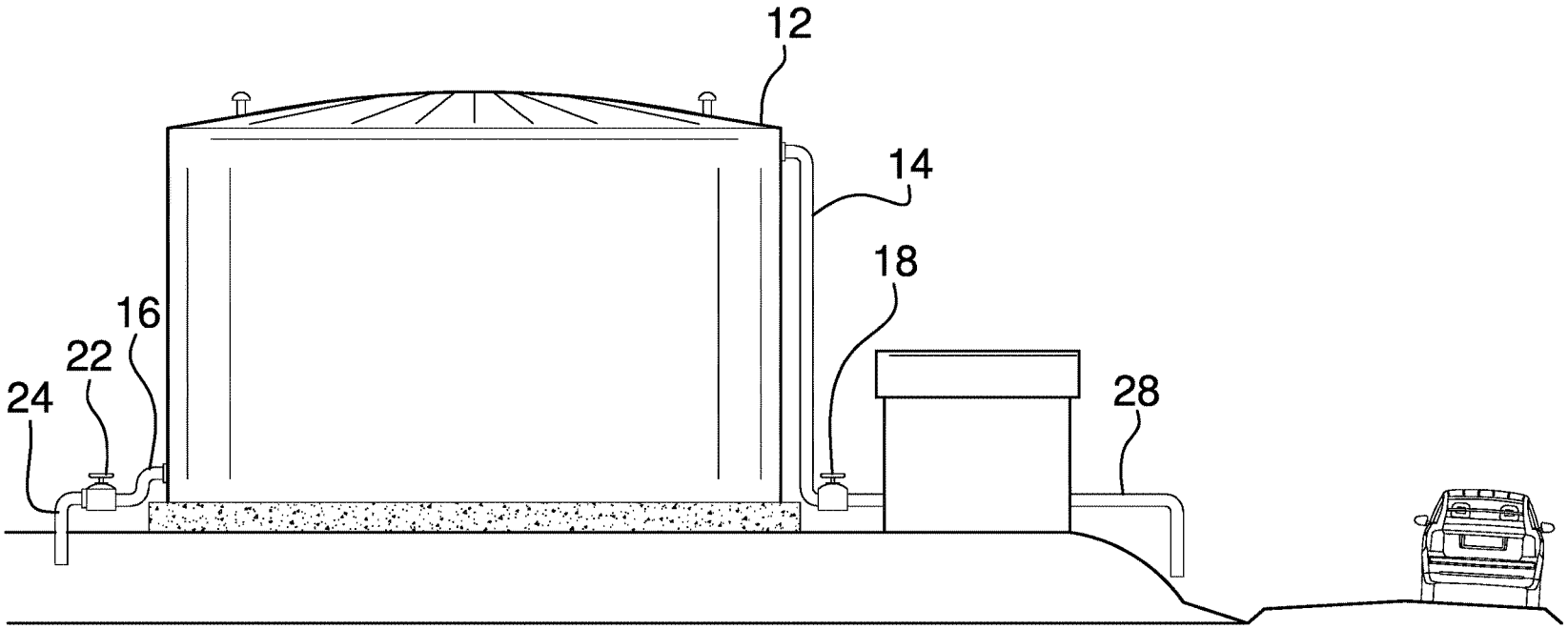
FIG. 1 is a perspective view of a flood water retention assembly according to an embodiment of the disclosure.
Figure 2:
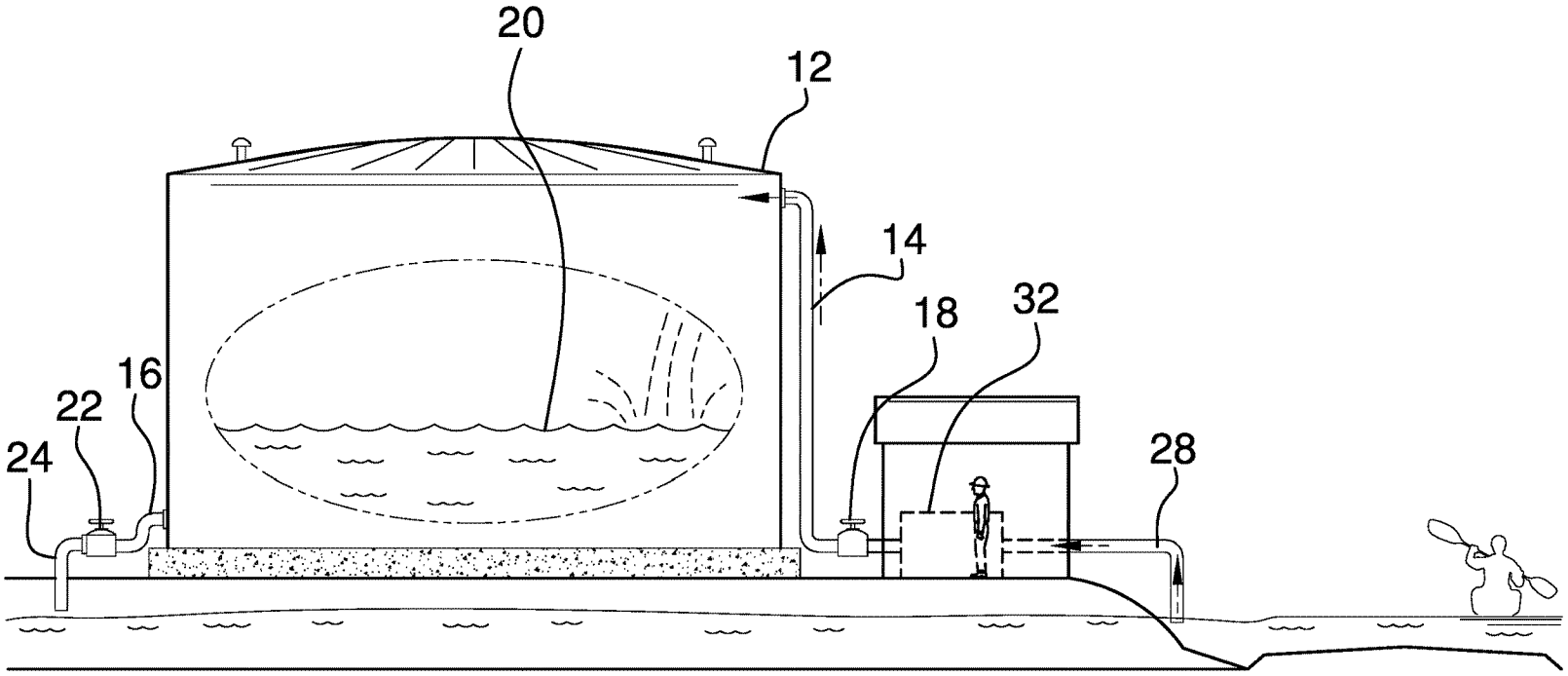
FIG. 2 is a phantom in-use view of an embodiment of the disclosure.
Figure 3:
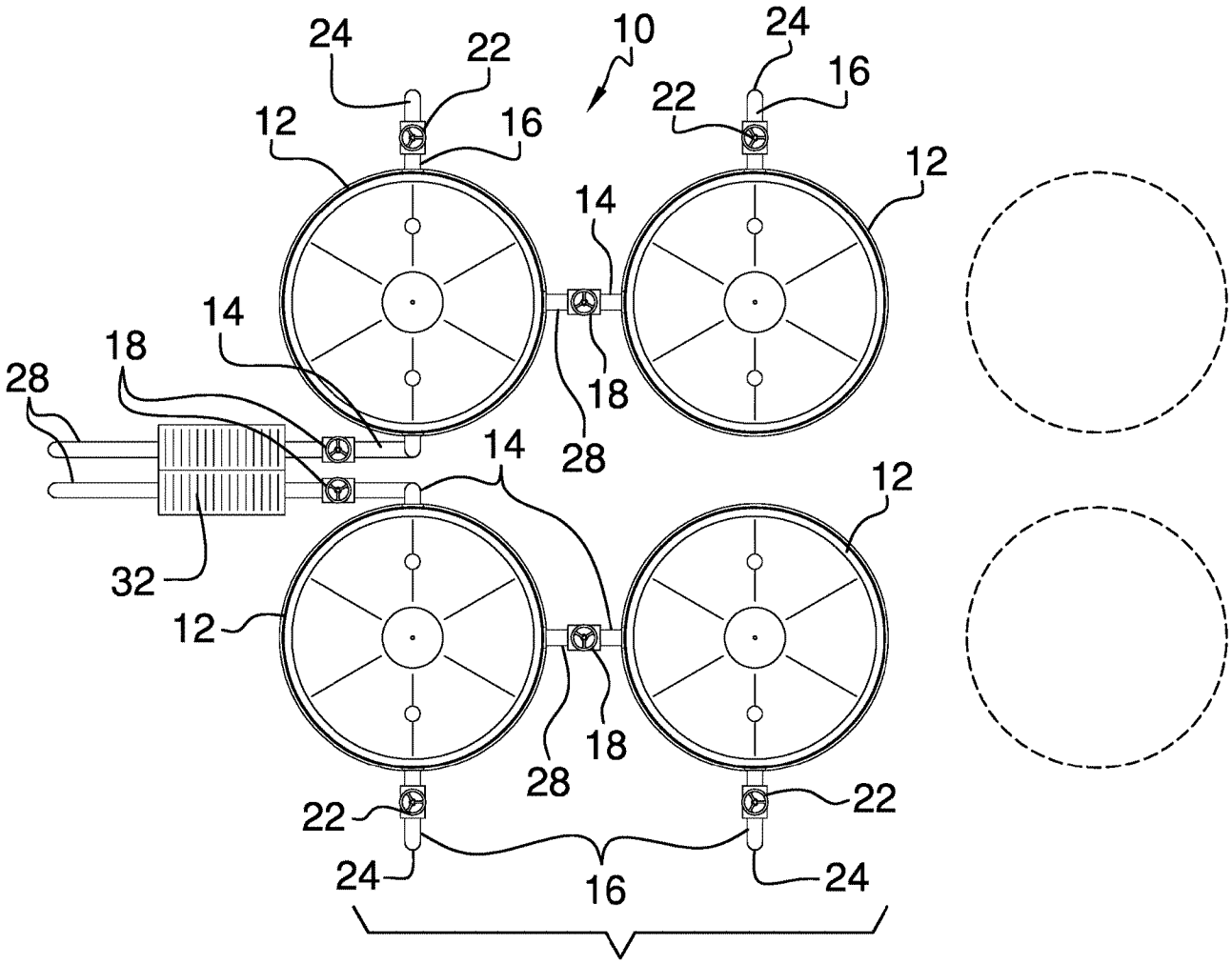
FIG. 3 is a top view of an embodiment of the disclosure.
Figure 4:
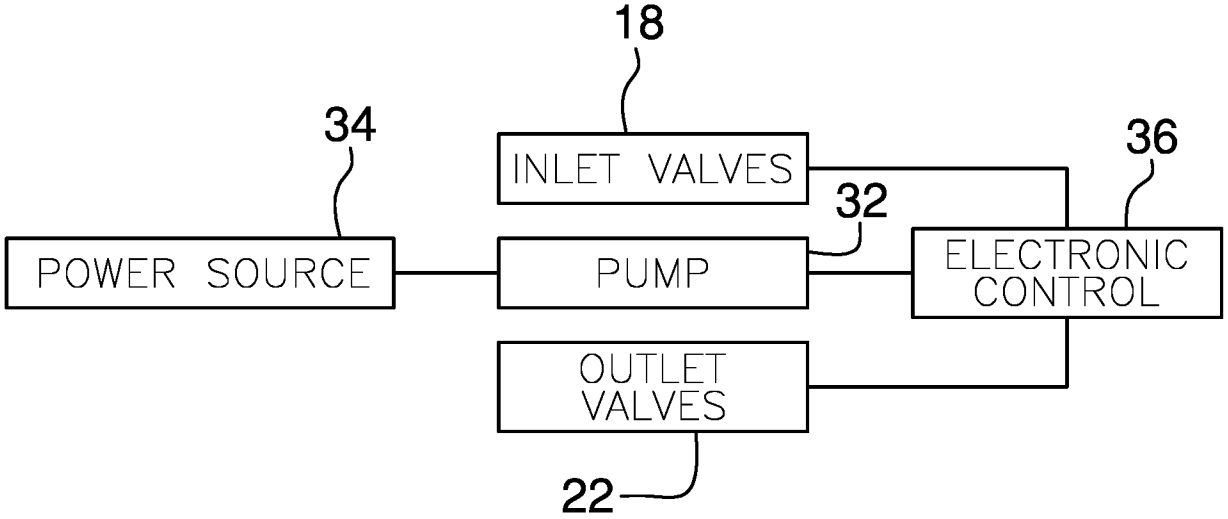
FIG. 4 is a schematic view of an embodiment of the disclosure.

With reference now to the drawings, and in particular to FIGS. 1 through 4 thereof, a new retention device embodying the principles and concepts of an embodiment of the disclosure and generally designated by the reference numeral 10 will be described.

As best illustrated in FIGS. 1 through 4, the flood water retention assembly 10 generally comprises a plurality of repositories 12 that may each be positioned proximate a lowland area prone to flooding. The lowland area may be a floodplain, a bayou or any other topography that commonly floods. Each of the repositories 12 has an inlet 14 and an outlet 16, and each of the repositories 12 has a minimum fluid capacity of 1,000,000 fluid gallons. Moreover, each of the repositories 12 may be a tank, a reservoir or any other type of water containment and each of the repositories 12 is ventilated for leveling atmospheric pressure within the repositories 12.

A plurality of inlet valves 18 is provided and each of the inlet valves 18 is fluidly coupled to the inlet 14 on a respective one of the repositories 12. Each of the inlet valves 18 is positionable in an open position to facilitate water 20 to flow into the respective repository. Additionally, each of the inlet valves 18 is positionable in a closed position to inhibit water 20 from flowing through the inlet 14 on the respective repository. A plurality of outlet valves 22 is each fluidly coupled to the outlet 16 on a respective one of the repositories 12. Each of the outlet valves 22 is positionable in an open position to facilitate water 20 to flow out of the respective repository. Additionally, each of the outlet valves 22 is positionable in a closed position to inhibit water 20 from flowing through the outlet 16 on the respective repository. Each of the inlet 14 and outlet valves 22 may be fluid valves of any conventional design.

A plurality of drain conduits 24 is each fluidly coupled to a respective one of the outlet valves 22. Each of the drain conduits 24 is in fluid communication with a drainage area 26 to drain the water 20 into the drainage area 26. The drainage area 26 may be a river, a creek, a water 20 retention pond or any other type of body or water 20. A plurality of inlet conduits 28 is each of the inlet conduits 28 is fluidly coupled to a respective one of the inlet valves 18. Additionally, each of the inlet conduits 28 is in fluid communication with a body of water 30 such that each of the inlet conduits 28 receives water 20 from the body of water 30. The body of water 30 may be a river or other source of flood water 20 that puts the surrounding area at risk of flooding.

A pump 32 is fluidly coupled to each of the inlet conduits 28, the pump 32 is positioned adjacent to the body of water 30 and the pump 32 is positioned at ground level. The pump 32 pumps the water 20 into the repositories 12 when the pump 32 is turned on. In this way the repositories 12 can contain flood water 20 thereby reducing flood damage to surrounding areas. Moreover, each of the outlet valves 22 is selectively opened for draining the flood water 20 at a selected rate into the drainage area 26 at a controlled rate. The pump 32 may be a fluid pump 32 that has an output rate of at least 50,000 fluid gallons per second and the pump 32 may be positioned in a pump house or the like. Additionally, the pump 32 may be electrically coupled to a power source 34 comprising an electrical service line or the like. Each of the inlet valves 18, the outlet valves 22 and the pump 32 may be electrically coupled to an electronic control 36, or each of the inlet valves 18, outlet valves 22 and pump 32 may be manually operated.

In use, selected ones of the inlet valves 18 are opened prior to turning on the pump 32. Thus, the flood water 20 can be directed into a selected combination of repositories 12 or a single repository when the pump 32 is turned on. The pump 32 is turned on when the body of water 30 poses a flooding threat after heavy rain fall or other events that can cause flooding. Thus, the excessive water 20 flowing in the body of water 30 can be stored in the repositories 12 and subsequently released at a selected time and at a selected rate. In this way the low land area is protected from the threat of flooding.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A flood water retention assembly being configured to collect and selectively release flood waters, said assembly comprising:

a plurality of repositories, each of said repositories being positioned proximate a lowland area prone to flooding, wherein each of said repositories is configured to contain water, each of said repositories having a minimum fluid capacity of 1,000,000 fluid gallons, each of said repositories being ventilated for leveling atmospheric pressure within said repository;

a plurality of drain conduits, each of said drain conduits being fluidly coupled to a respective one of said repositories, each of said drain conduits being in fluid communication with a drainage area wherein each of said drain conduits is configured to drain the water into the drainage area;

a plurality of inlet conduits, each of said inlet conduits being fluidly coupled to a respective one of said repositories, each of said inlet conduits being in fluid communication with a body of water wherein each of said inlet conduits is configured to receive water from the body of water, at least one of said inlet conduits being in fluid communication with the body of water through another one of said repositories than said associated one of said repositories; and a pump being fluidly coupled to each of said inlet conduits, said pump being positioned adjacent to the body of water, said pump being positioned at ground level, said pump pumping the water into said repositories when said pump is turned on wherein said repositories are configured to contain flood waters thereby reducing flood damage to surrounding areas, said pump having an output rate of at least 50,000 fluid gallons per second.

2. The assembly according to claim 1, further comprising: each of said repositories having an inlet; and a plurality of inlet valves, each of said inlet valves being fluidly coupled to said inlet on a respective one of said repositories, each of said inlet valves being positionable in an open position to facilitate water to flow into said respective repository, each of said inlet valves being positionable in a closed position to inhibit water from flowing through said inlet on said respective repository.

3. The assembly according to claim 1, further comprising: each of said repositories having an outlet; and a plurality of outlet valves, each of said outlet valves being fluidly coupled to said outlet on a respective one of said repositories, each of said outlet valves being positionable in an open position to facilitate water to flow out of said respective repository, each of said outlet valves being positionable in a closed position to inhibit water from flowing through said outlet on said respective repository.

4. The assembly according to claim 3, further comprising wherein each of said outlet valves is selectively opened for draining the water at a selected rate into the drainage area wherein said repositories are configured to release the flood waters at a controlled rate.

5. A flood water retention assembly being configured to collect and selectively release flood waters, said assembly comprising:

a plurality of repositories, each of said repositories being positioned proximate a lowland area prone to flooding, each of said repositories having an inlet and an outlet, each of said repositories having a minimum fluid capacity of 1,000,000 fluid gallons, each of said repositories being ventilated for leveling atmospheric pressure within said repository;

a plurality of inlet valves, each of said inlet valves being fluidly coupled to said inlet on a respective one of said repositories, each of said inlet valves being positionable in an open position to facilitate water to flow into said respective repository, each of said inlet valves being positionable in a closed position to inhibit water from flowing through said inlet on said respective repository;

a plurality of outlet valves, each of said outlet valves being fluidly coupled to said outlet on a respective one of said repositories, each of said outlet valves being positionable in an open position to facilitate water to flow out of said respective repository, each of said outlet valves being positionable in a closed position to inhibit water from flowing through said outlet on said respective repository;

a plurality of drain conduits, each of said drain conduits being fluidly coupled to a respective one of said outlet valves, each of said drain conduits being in fluid communication with a drainage area wherein each of said drain conduits is configured to drain the water into the drainage area;

a plurality of inlet conduits, each of said inlet conduits being fluidly coupled to a respective one of said inlet valves, each of said inlet conduits being in fluid communication with a body of water wherein each of said inlet conduits is configured to receive water from the body of water, at least one of said inlet conduits being in fluid communication with the body of water through another one of said repositories than said associated one of said repositories; and a pump being fluidly coupled to each of said inlet conduits, said pump being positioned adjacent to the body of water, said pump being positioned at ground level, said pump pumping the water into said repositories when said pump is turned on wherein said repositories are configured to contain flood waters thereby reducing flood damage to surrounding areas, wherein each of said outlet valves is selectively opened for draining the water at a selected rate into the drainage area wherein said repositories are configured to release the flood waters at a controlled rate, said pump having an output rate of at least 50,000 fluid gallons per second.

* * * * *